United States Patent [19]

Campbell

[11] Patent Number: 4,548,060

[45] Date of Patent: Oct. 22, 1985

[54] LOCKING DEVICE FOR VENDING MACHINES

[76] Inventor: George T. Campbell, Rte. 2, Box 676, Liberty, S.C. 29657

[21] Appl. No.: 554,996

[22] Filed: Nov. 25, 1983

[51] Int. Cl.[4] ..... E05B 65/00

[52] U.S. Cl. ..... 70/91; 70/93; 70/101; 70/371

[58] Field of Search ..... 70/14, 15, 18, 30, 32, 70/33, 34, 49, 57, 58, 91, 93, 101, 102, 371, 77, 78; 292/259, 262, 288

[56] References Cited

U.S. PATENT DOCUMENTS

| | | | |
|---|---|---|---|
| 1,274,051 | 7/1918 | Jacobson et al. | 70/101 |
| 2,904,986 | 9/1959 | Anderson | 70/101 |
| 2,999,377 | 9/1961 | Raye | 70/32 |
| 3,446,046 | 5/1969 | Randel | 70/101 |
| 3,933,015 | 1/1976 | Balicki | 70/18 |

FOREIGN PATENT DOCUMENTS

| | | | |
|---|---|---|---|
| 1499959 | 9/1967 | France | 70/93 |

*Primary Examiner*—Robert L. Wolfe

*Attorney, Agent, or Firm*—Bailey & Hardaway

[57] ABSTRACT

Disclosed is a locking device which comprises a stationary member permanently mounted on a door structure together with a passive stationary block permanently mounted on adjacent wall structures which is connected to an interlocking member by means of an armored cable, the interlocking member interlocking with the stationary member to preclude movement in all directions but one and with a cylindrical barrel lock interlocking with both the stationary member and the interlocking member to preclude movement in the remaining one direction. The entire structure is generally invulnerable to attack by conventional burglary tools unless such attack is carried out for excessive periods of time, e.g., an hour or longer.

6 Claims, 4 Drawing Figures

LOCKING DEVICE FOR VENDING MACHINES

BACKGROUND OF THE INVENTION

This invention relates generally to the art of locks and more particularly to the art of securing vending machines against thefts therefrom.

Thefts from vending machines have presented significant problems to vendors for many years. This problem has been particularly severe with beverage vending machines and even more severe with such beverage vending machines when they are located in an unattended environment loss due to theft as well as the repair of the machine itself. Such losses frequently represent the major expense associated with such vending enterprise. These thefts involve not only the removal of money from coin operated machines but also removal of merchandise and structural damage to the machines itself.

In the past such vending machine have relied upon a conventional cylindrical barrel lock to lock the door structure to the internal structure of the machine itself. Such conventional structures have required only the use of a crowbar or other leveraging means to pry open the door structure. Attemps to overcome these shortcomings have comprised placement of the vending machines within cells formed of steel bars so as to provide hand access only through openings provided. Other attempts have comprised placement of padlocks along the sides of the machines in addition to the conventional cylindrical barrel lock. Such attemps however have resulted in vending machines which are more difficult to pilfer but which are still vulnerable to attack by means of hacksaws, bolt cutters or sledgehammers with the breaking in operation requiring only a short period of time.

SUMMARY OF THE INVENTION

It is thus an object of this invention to provide a novel locking device for use upon a vending machine.

It is a further and more particular object of this invention to provide such a locking device which can only be broken into with the use of excessive force for an excessive period of time.

It is a yet further object of this invention to provide such a locking device which is simple in construction and easily operable.

These are well as other object are accomplished by a locking device which comprises a stationary member permanently mounted on a door structure together with a passive stationary block permanently mounted on adjacents wall structure which is connected to an interlocking member by means of an armored cable. The interlocking member interlocks with the stationary member so as to preclude movement in all directions but one. A cylindrical barrel lock interlocks with both the stationary member and the interlocking member to preclude movement in the remaining one direction. The entire structure is generally invulnerable to attack by conventional burglary tools unless such attack is carried out for excessive periods of time, e.g., an hour or longer.

DETAILED DESCRIPTION

In accordance with this invention it has been found that a locking device for a vending machine may be provided which is simple in construction yet which provides a structure which is, for practical purposes, impenetrable to conventional pilfering. The locking device in accordance with this invention presents to a thief an obstacle which is large compared to the potential gain and compared to the risk involved. The locking device of this invention requires an excess of one hour to be broken when conventional burglary tools, e.g., crowbars, hacksaws, sledgehammers and cableshears, are utilized. Various other advantages and features of the locking device in accordance with this invention will become apparent from the following description given with reference to the various figures of drawing.

Figure 1:
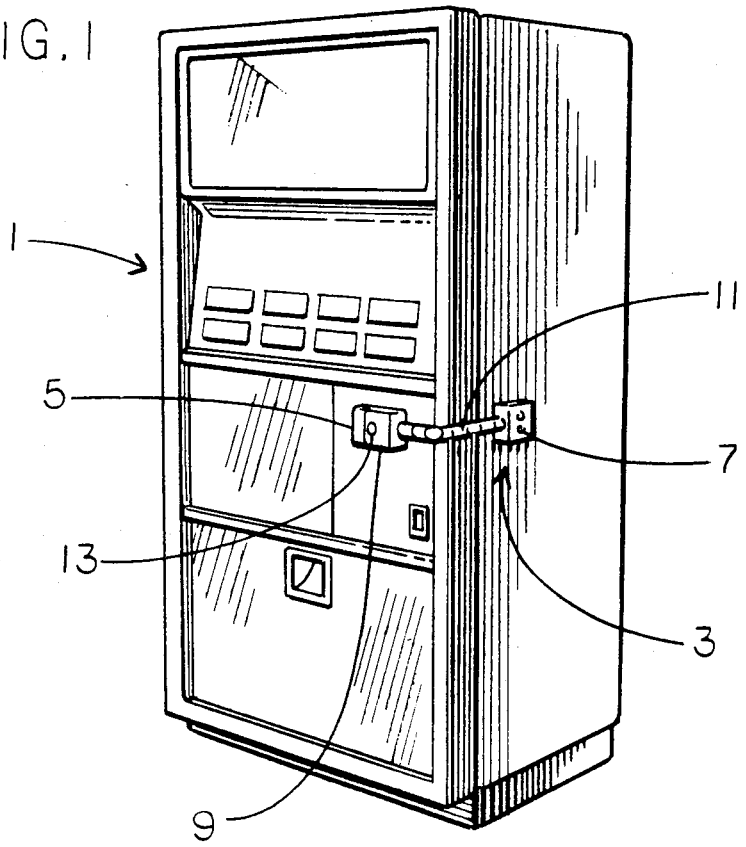
FIG. 1 of the drawings illustrates a vending machine having the locking device of this invention thereon.

FIG. 1 of the drawings illustrates a conventional vending machine 1. The vending machine illustrated therein has thereon a locking device which is referred to as 3 in its entirity. The locking device 3 comprises a stationary member 5, a passive stationary block 7, an interlocking member 9 and an armored cable 11. The stationary member 5 and interlocking member 9 are locked together by a tampered-proof cylindrical barrel lock 13. Such barrel lock may be of the type conventionally utilized in vending machines.

Figure 2:
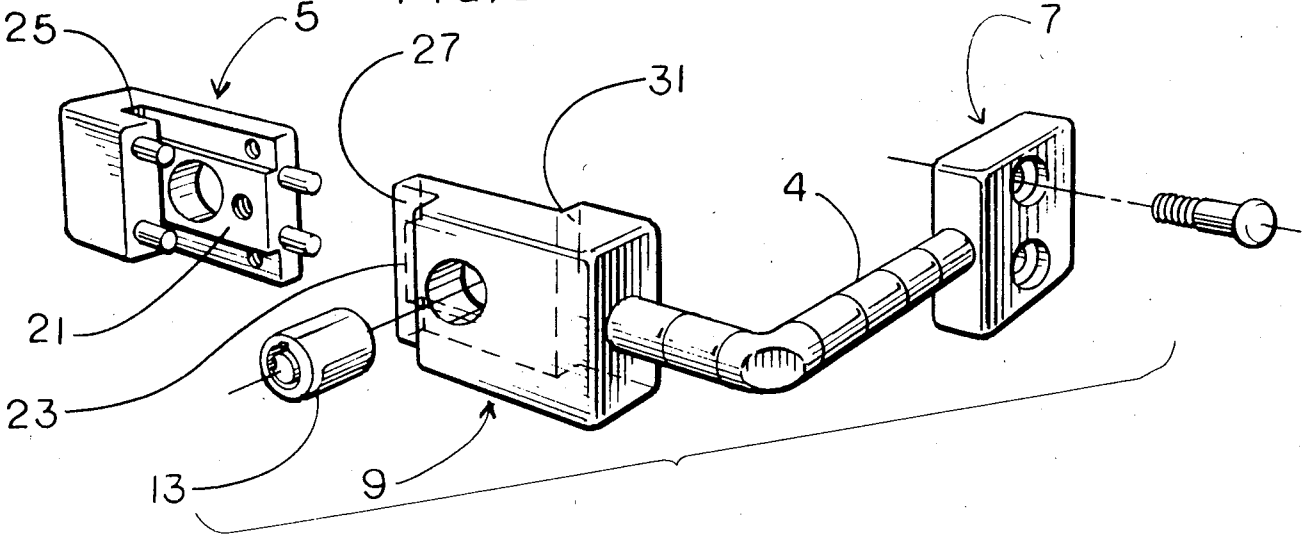
FIG. 2 of the drawings is a perspective assembly view of the locking device in accordance with this invention.

The locking device may be better understood by reference to FIG. 2 of the drawings which illustrates the device in an assembly perspective view. Stationary member 5 and interlocking member 9 are interlocked in such a manner to provide solid contact surfaces therebetween in all directions except the one direction through which the two members may be disengaged. This single direction is provided for by means of a cylindrical barrel lock 13 which precludes movement in that direction.

To this end stationary member 5 is provided with a tongue 21 which slidably receives a groove 23 of interlocking member 9. Additionally stationary member 5 comprises an undercut portion 25 for receipt of a mating portion 27 of interlocking member 9. Additionally the tongue and groove, 21 and 23, may be in the form of a dovetail connection to provide even less freedom of movement between the interlocking parts. Additionally it is preferred that interlocking member 9 in addition in mating to the undercut 25 abut member 5 along its own undercut portion 31.

It is thus seen that through a series of tongue and groove and undercut connections stationary member 5 and interlocking member 9 fit together in such a way that the only direction provided for movement is along the tongue and groove in the direction designed for engagement and disengagement.

It is further seen that the abutting surfaces are such that if the assembled members are attacked, such as by a sledgehammer, forces will be transmitted to major abutting surfaces rather than to weak points which may tend to fail from such abuse.

Cylindrical barrel lock 13 is the only obstacle to movement in the single direction permitted by the interlocking of the stationary member 5 and interlocking member 9. Due to the nature of the interlock between the stationary member 5 and interlocking member 9 it is difficult if not impossible to apply force in the disengaging direction so as to damage cylindrical barrel lock 13. Additionally cylindrical barrel lock 13 is rugged and capable of withstanding significantly more abuse than could be provided to the structure illustrated in FIG. 2 by conventional burglary tools.

Figure 4:
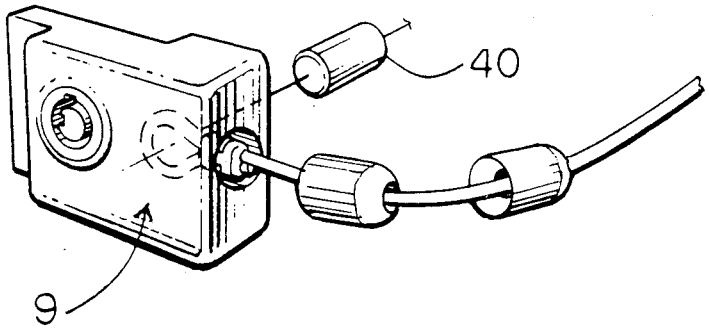
FIG. 4 of the drawings illustrates interconnection of elements of the invention.
Figure 3:
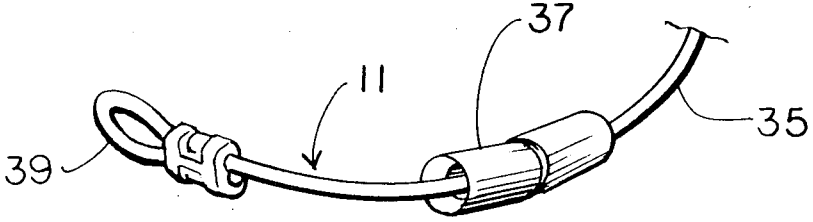
FIG. 3 of the drawings illustrates an armored cable in accordance with this invention.

The armored cable 11 is particularly illustrated in FIG. 3 wherein it is seen that the armored cable comprises a steel strand cable 35 which is armored with bullet shaped armor sections 37. Each armor section 37 has a hollow passageway therethrough for receipt of the steel strand cable. Each armored section interfits with each adjacent section to throughly surround the steel strand cable and prevent ingress of cablesheers or hacksaws or other cutting instruments. FIG. 3 illustrates a loop in the strand cable 35 which is utilized on both ends thereof for internal attachments to block 7 and interlocking member 9. A simply steel pin 40 interposed through loop 39 provides for secure attachments at both ends thereof with armor section continuing to the internal portion of the block 7 and interlocking member 9 as shown by the dotted line in FIG. 4.

Both stationary member 5 and block 7 are attached to a conventional vending maching by means of steel bolts which are preferably recessed within the structure by well-known techniques. Preferably these structures are attached through the metallic facing of the vending machine to steel reinforcing plates on the interior thereof and are simply bolted therethrough.

All structures utilized in this invention are preferable of case hardened steel. Particularly the stationary member 5, interlocking member 9, block 7 and armor section 37 are comprised of case hardened steel. Such a structure has been tested and found to require in excess of one hour to disengage from a vending machine. This period of time is excessive and would discourage even the most zealous thief.

It is thus seen that the locking device of this invention provides a novel locking device which is simple and inexpensive in construction but which for all practible purposes renders the structure so locked generally impenetrable to conventional attack. As many variations will become apparent from a reading of above specification which is exemplary in nature, such variations are included within the spirit and scope of the following appended claims.

What is claimed is:

1. A locking device for an exterior door structure, comprising:

a stationary member pemanently mounted on said door structure, and defining an opening therethrough for receipt of a cylindrical barrel lock;

a passive stationary block permanently mounted on a wall structure adjacent said door structure;

an armored cable connected at one end to said passive stationary block;

an interlocking member connected to the other end of said armored cable and defining an opening therethrough for receipt of said cylindrical barrel lock, said interlocking member slidable interlocking with said stationary member to provide solid contact surfaces therebetween in all directions but one direction, said one direction providing for sliding engagement and disengagement between said stationary member and said interlocking member; and a cylindrical barrel lock for receipt within said openings of said stationary member and said interlocking member to preclude movement in said one direction.

2. A locking device according to claim 1 wherein said stationary member and said interlocking member slidably interlock through a tongue and groove, said tongue and groove interconnection precluding relative movement between said members.

3. A locking device according to claim 2 wherein said tongue and groove are dovetailed to preclude movement in a first horizontal direction.

4. A locking device according to claim 2 wherein said interlocking member slides into an undercut on said stationary member, said interlocking member mating with said undercut which together with said tongue and groove precludes relative movement between said members in all directions except said one direction.

5. A locking device according to claim 1 wherein said armored cable comprises a steel strand cable, armored with bullet shaped armor sections, each of said sections having hollow passageways therethrough for receipt of said strand cable and each armor section interfitting with each adjacent armor section to thoroughly surround said strand cable and preclude contact of said strand cable by cutting means.

6. A locking device according to claim 1 wherein said door is metallic and attached to a vending machine and said wall structure is a metallic side wall to a vending machine and said stationary member and said block are attached to steel plate reinforcement of the interior of said vending machine.

* * * * *